US009810110B2

(12) United States Patent
Grosch et al.

(10) Patent No.: US 9,810,110 B2
(45) Date of Patent: Nov. 7, 2017

(54) VALVE LIFT CONTROL DEVICE WITH CYLINDER DEACTIVATION

(71) Applicant: Ford Global Technologies, LLC, Dearborn, MI (US)

(72) Inventors: Guenter Hans Grosch, Vettweiss (DE); Rainer Lach, Wuerselen (DE); Joerg Bonse, Wuerselen (DE)

(73) Assignee: Ford Global Technologies, LLC, Dearborn, MI (US)

( * ) Notice: Subject to any disclaimer, the term of this patent is extended or adjusted under 35 U.S.C. 154(b) by 76 days.

(21) Appl. No.: 14/828,932

(22) Filed: Aug. 18, 2015

(65) Prior Publication Data

US 2016/0061069 A1 Mar. 3, 2016

(30) Foreign Application Priority Data

Sep. 3, 2014 (DE) ..... 10 2014 217 531

(51) Int. Cl.
*F01L 1/34* (2006.01)
*F01L 13/00* (2006.01)

(52) U.S. Cl.
CPC ..... *F01L 13/0047* (2013.01); *F01L 13/0005* (2013.01); *F01L 2013/001* (2013.01)

(58) Field of Classification Search
CPC ..... F01L 13/0047; F01L 13/0005; F01L 2013/001
USPC ..... 123/90.16, 90.6, 90.39, 90.44
See application file for complete search history.

(56) References Cited

U.S. PATENT DOCUMENTS

| | | | | |
|---|---|---|---|---|
| 6,135,076 | A * | 10/2000 | Benlloch Martinez | F01L 13/0047 123/90.16 |
| 6,868,811 | B2 * | 3/2005 | Koro | F01L 1/044 123/90.15 |
| 7,673,601 | B2 | 3/2010 | Spath et al. | |
| 7,836,866 | B2 | 11/2010 | Luken et al. | |
| 8,042,504 | B2 | 10/2011 | Berger | |
| 8,807,104 | B2 | 8/2014 | Flierl | |
| 2008/0083385 | A1 | 4/2008 | Han et al. | |

FOREIGN PATENT DOCUMENTS

| | | | |
|---|---|---|---|
| DE | 3913523 | A1 | 11/1989 |
| DE | 102005040959 | A1 | 3/2007 |
| DE | 102010048709 | A1 | 4/2012 |
| DE | 102010055515 | A1 | 6/2012 |
| DE | 102012006983 | A1 | 10/2013 |

* cited by examiner

*Primary Examiner* — Ching Chang
(74) *Attorney, Agent, or Firm* — Julia Voutyras; McCoy Russell LLP

(57) ABSTRACT

Methods and systems are provided for a valve lift control device. In one example, a method may include rotating an adjusting camshaft of the valve lift control device in order to adjust a valve lift of one or more cylinders.

7 Claims, 11 Drawing Sheets

800
START
802
DETERMINE CURRENT ENGINE OPERATING PARAMETERS
804
DETERMINE ENGINE LOAD
806
ENGINE LOAD LESS THAN FIRST THRESHOLD?
NO
YES
808
MAINTAIN CURRENT ENGINE OPERATING PARAMETERS AND KEEP ALL CYLINDERS ACTIVE
EXIT
810
ENGINE LOAD LESS THAN SECOND THREHSOLD?
NO
YES
CONT. TO FIG. 8B
812
ENGINE LOAD LESS THAN THIRD THRESHOLD?
NO
YES
CONT. TO FIG. 8C
CONT. TO FIG. 8D

VALVE LIFT CONTROL DEVICE WITH CYLINDER DEACTIVATION

CROSS REFERENCE TO RELATED APPLICATIONS

The present application claims priority to German Patent Application No. 102014217531.3, filed Sep. 3, 2014, the entire contents of which are hereby incorporated by reference for all purposes.

FIELD

The present description related generally to methods and systems for a valve lift control device for a combustion engine.

BACKGROUND/SUMMARY

Internal combustion engine systems may operate a series of gas exchange valves in each cylinder of the engine to provide gas flow through the cylinders. One or more intake valves open to allow charge air with or without fuel to enter the cylinder while one or more exhaust valves open to allow combusted matter such as exhaust to exit the cylinder. Intake and exhaust valves may be poppet valves actuated via linear motion provided directly or indirectly by cam lobes attached to a rotating camshaft. The rotating camshaft may be powered by an engine crankshaft. Some engine systems variably operate the intake and exhaust valves to enhance engine performance as engine conditions change. Variable operation of the intake and exhaust valves along with their respective cam lobes and camshafts may be generally referred to as cam actuation systems. Cam actuation systems may involve a variety of schemes such as cam profile switching, variable cam timing, valve deactivation, variable valve timing, and variable valve lift. As such, systems and methods for cam actuation systems may be implemented in engines to achieve more desirable engine performance. Other attempts to address cylinder deactivation and/or variable valve lift include using hydraulic devices. There are attempts to control the valves by means of hydraulic devices in such a way that the valves can be opened only in predetermined steps or not at all.

However, the inventors have recognized potential issues with such systems. As one example, hydraulic devices utilize complex hydraulic circuits designed to deliver high and low pressure hydraulic fluid to operate actuating mechanisms in order to function as desired. Furthermore, hydraulic devices may be used with other valve lift control devices (e.g., a camshaft), which may lead to packaging issues.

In one example, the issues described above may be addressed by a method comprising rotatably actuating an asymmetric camshaft in a first and second directions in order to variably adjust one or more valves of one or more cylinders, wherein actuation to a first position in the second direction deactivates a first cylinder. In this way, individual cylinder valves may be adjusted independently via a common valve lift control device.

As one example, the asymmetric camshaft is actuated to the first position in the second direction in order to deactivate only a single cylinder of a cylinder bank. The camshaft may be further actuated in the second direction to deactivate one or more of the remaining cylinders in response to an engine load decreasing. The deactivated cylinders may be reactivated by rotatably actuating the camshaft in the first direction, where the first direction is opposite the second direction. In this way, the valve lift control device achieves a combination of variable valve lift control and cylinder shutdown in one system by means of a single arrangement. It is possible both for the instantaneous maximum permissible valve lift to be reduced in the case of a low power demand and for individual cylinders to be shut down in succession in the case of an even lower power demand. As a result, fuel consumption is more economical than in a conventional setup.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 1A, 1B, 2A, 2B, 3A, 3B, 4, 5A, 5B, and 6 are to scale.

DETAILED DESCRIPTION

Figure 4:
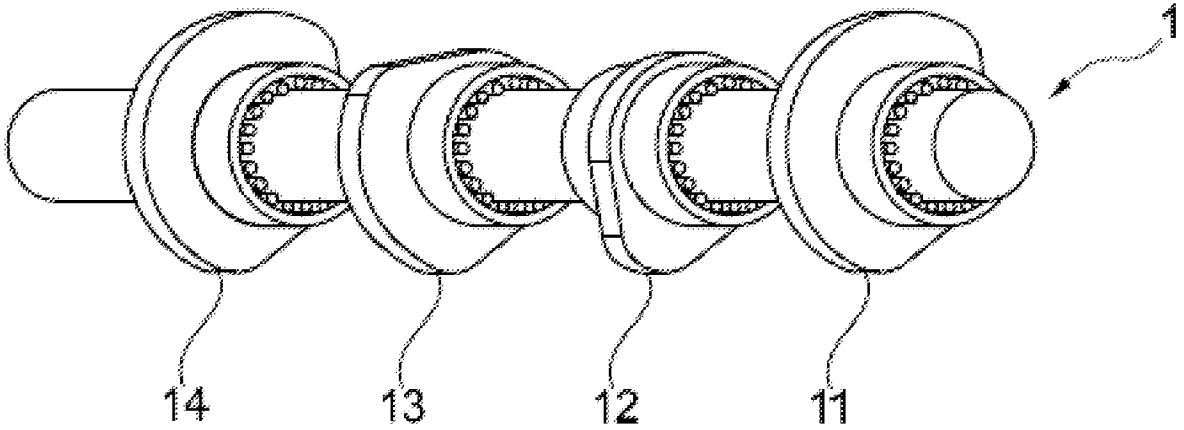
FIG. 4 shows the adjusting shaft in a view from the side and front illustrating an asymmetric camshaft.
Figure 5A:
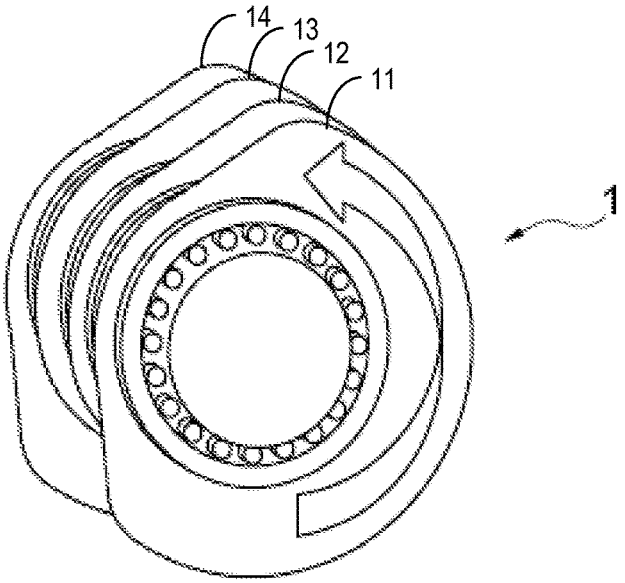
FIG. 5A shows the valve lift control device in a view from the side and front, indicating the first direction of rotation of the adjusting shaft.
Figure 5B:
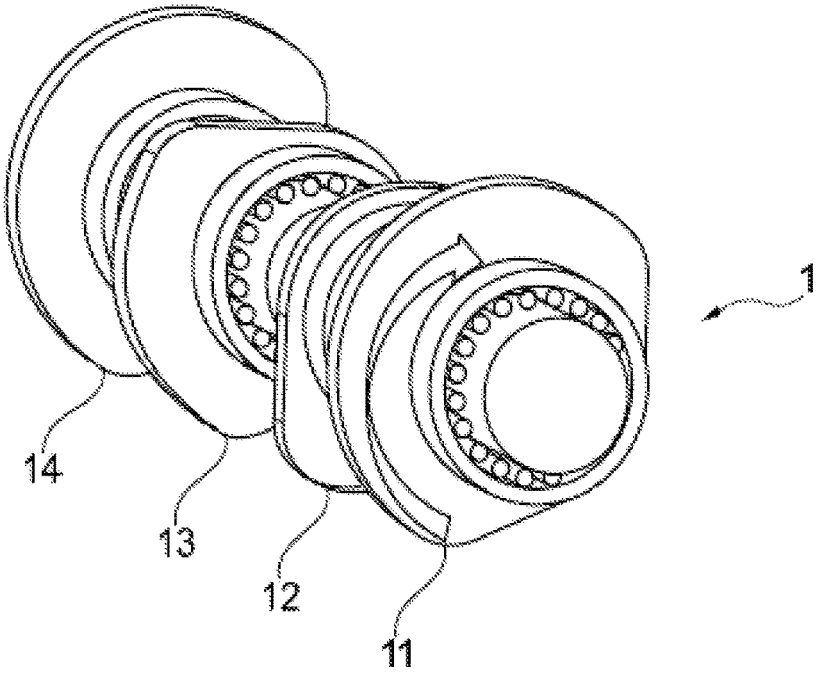
FIG. 5B shows the valve lift control device in a view from the side and front, indicating the second direction of rotation of the adjusting shaft.
Figure 6:
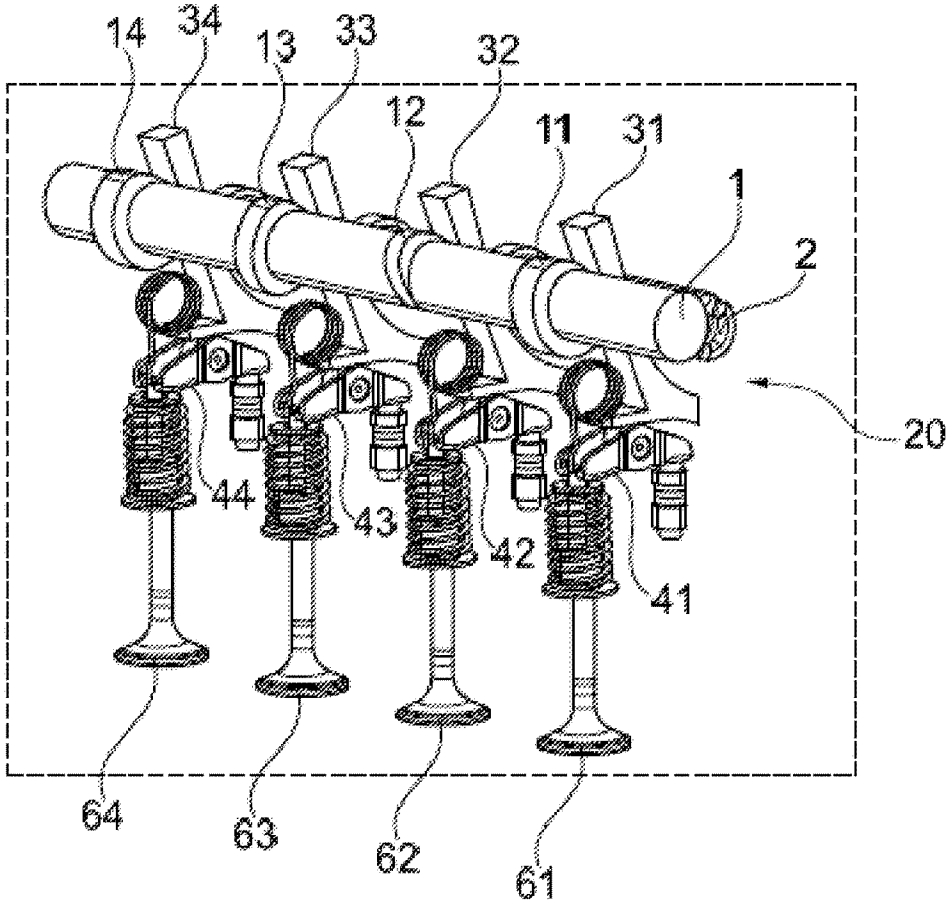
FIG. 6 shows the valve lift control device for a cylinder row and/or bank having four cylinders in a view from the side and front.
Figure 7:
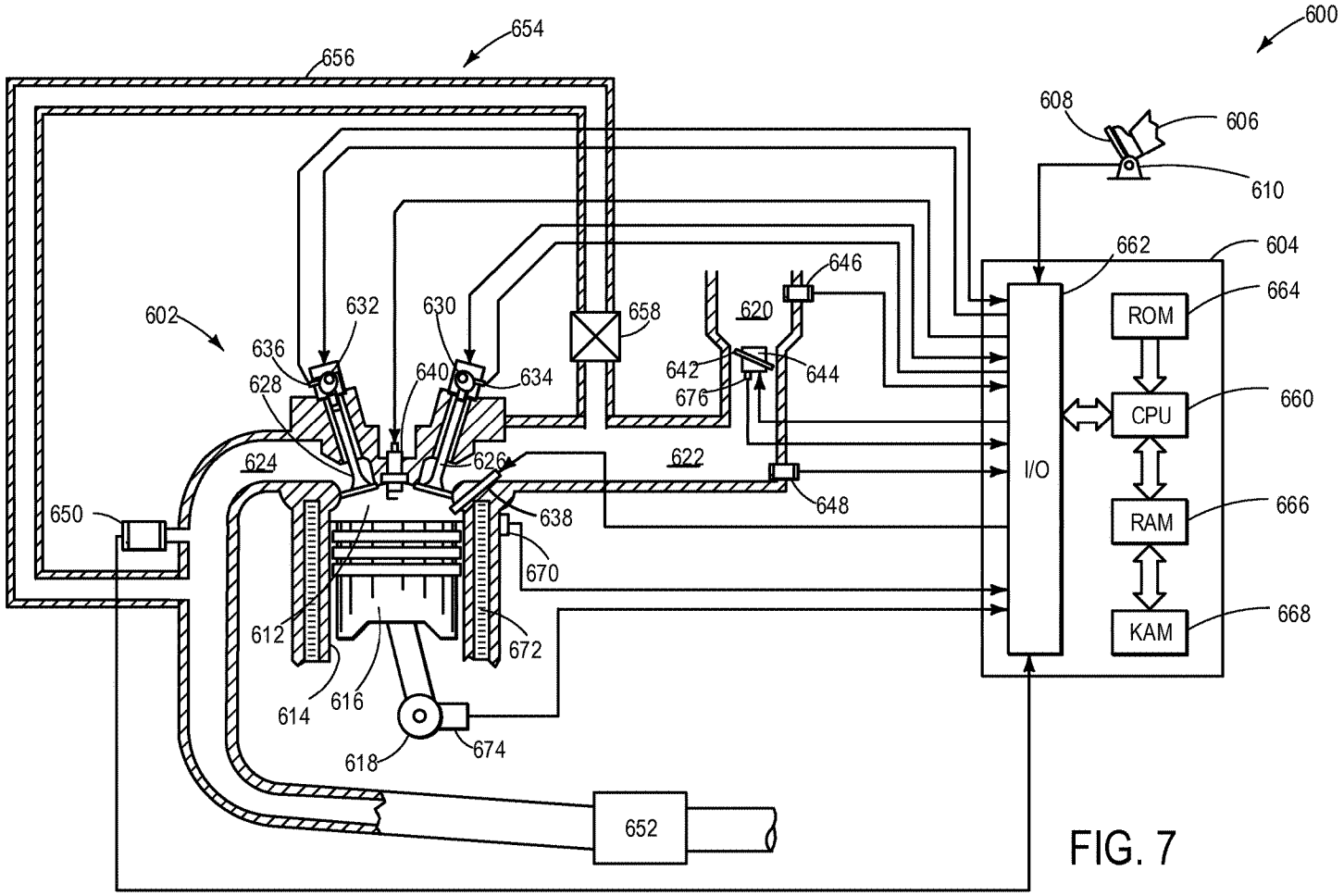
FIG. 7 shows an engine comprising a cylinder with intake and exhaust valves able to be coupled to the valve lift control device.

The following description relates to systems and methods for controlling a valve lift control device. Based on a degree of rotation, the valve lift control device may alter a valve position of one or more cylinders of an engine. FIGS. 1A, 1B, 2A, 2B, 3A, and 3B depict various degrees of rotation of the valve lift control device in order to adjust a position of a valve of a cylinder. The valve lift control device is asymmetric and comprises various eccentricies (e.g., cams) with offset radii, as shown in FIG. 4. The valve lift control device may be rotatably actuated in a first direction and a second direction, as shown in FIGS. 5A and 5B, in order to alter a radial effect of the eccentricies. The second direction is a direction opposite the first direction. The valve lift control device may be used for a cylinder row or a cylinder bank, as shown in FIG. 6. An engine with the valve lift control device is shown in FIG. 7. A method for operating the valve lift control device in response to a changing engine operation is shown in FIG. 7.

Figure 1A:
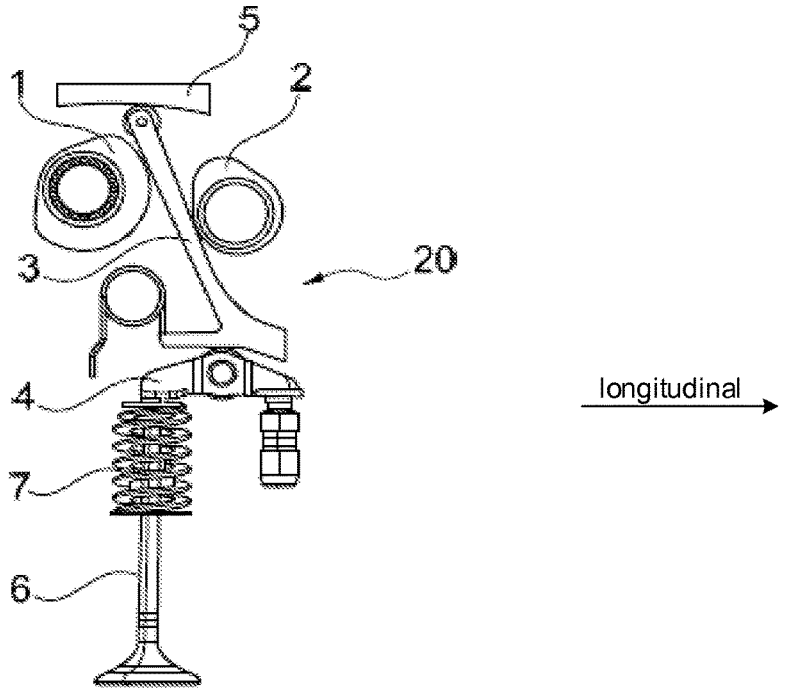
FIG. 1A shows a valve lift control device in a front view.

Turning now to FIG. 1A, a valve lift control device (VLCD) 20 for a combustion engine consists of at least one cylinder row with a first cylinder and at least one second cylinder (not shown), comprising a camshaft 2. The VLCD 20 may be used to actuate individual valves of the one or more cylinders independently.

The VLCD 20 may be used with various cylinder set ups. For example, the VLCD 20 may be used with an inline 4, 6, and/or 8 cylinder engine. The VLCD 20 may be used with rotary engines, V6, V8, V10, and V12 engines. The VLCD 20 may also be used with sparkles engines.

In one example, the VLCD 20 may adjust valve positions of corresponding valves of corresponding cylinders of a single bank, while a second VLCD, substantially identical to VLCD 20, operates a separate cylinder bank. In such an example, the VLCDs may operate identically or differently. In this way, one cylinder bank may be operated different than the second cylinder bank.

The VLCD 20 is shown coupled to a single poppet valve 6 of a cylinder. The valve 6 may be an intake valve or an exhaust valve. Furthermore, cylinders may comprise two or more intake poppet valves and/or two or more exhaust poppet valves. Thus, the camshaft 2 and an adjusting camshaft 1 may comprise a number of cams corresponding to a number of poppet valves located on the cylinders.

The camshaft 2 is in a non-positive connection with the first and at least the second cylinder. In other words, the camshaft 2 may actuate the first cylinder without actuating the second cylinder. In this way, the camshaft 2 is designed to be in non-positive connection (e.g., non-locking connection via each cylinder comprising one activation lever 3, which is mounted on a support bearing 5 arranged movably on a cylinder head). A second lever 4 is located geodetically below the activation lever 3 and acts on the poppet valve 6. The second lever 4 is a lever that is mechanically suitable for converting a deflection movement of the activation lever 3 into a linear movement of the poppet valve 6. The second lever 4 may be a finger follower, a roller-type finger follower, a rocker arm, or a roller rocker arm.

The camshaft 2 is located on a first side of the activation lever 3, and the adjusting shaft 1 is arranged on a second side of the activation lever 3, where the second side is opposite the first side. This enables the adjusting shaft 1 to push the activation lever 3 against a force the camshaft 2 by means of its cams when rotated in either a first or second directions. The activation lever 3 comprises a rotary motion with the surface of the camshaft 2 as an axis of rotation (e.g., the activation lever 3 moves obliquely to a body of the camshaft 2). During this process, the end of the activation lever 3 supported on the support bearing 5 moving along the cylinder head in one direction and the end thereof which is in operative connection with and physically coupled to the second lever 4 moves in the opposite direction (e.g., a see-saw-like motion).

In one example, the camshaft 2 and the adjusting shaft 1 may be mechanically coupled and adjusted via a crankshaft. Alternatively, the camshaft 2 and the adjusting shaft 1 may be operated via instructions from a controller (e.g., electrically controlled). Additionally or alternatively, the camshaft 2 and the adjusting shaft 1 may be controlled by the crankshaft, the controller, or a combination thereof.

The activation lever 3 is actuated via the camshaft 2 and the adjusting shaft 1. The second lever 4 acts on the poppet valve 6 based on the actuation of the activation lever 3. In this way, the second lever 4 may act on the poppet valve 6 of the respective cylinder (e.g., each cylinder comprises a second lever and an activation valve adjustable by the camshaft 2 and adjusting shaft 1 independently of other cylinders of an engine) counter to the force of a valve spring 7. Alternatively, the second lever 4 may be actuated by the force of the valve spring 7 exceeding a force applied by the activation lever 3, based on rotation of the camshaft 2 and the adjusting shaft 1. In one example, the force of the valve spring 7 may be overcome by rotating the adjusting shaft in a first direction, thereby moving the poppet valve 6 to a more open position.

The camshaft 2 and adjusting shaft 1 are rotated to adjust a valve lift of the poppet valve 6 of the respective cylinder (e.g., the first cylinder). The adjusting shaft 1 may modify an angular position of the activation lever 3 relative to the cylinder head in each cylinder, and on which the cams are of different designs, as will be described below. In one example, the angular position of the activation lever 3 increases as the valve lift of the poppet valve 6 moves to a maximum valve lift position.

The poppet valve 6 is opened directly by the second lever 4, wherein valve opening takes place counter to the force of the spring 7. The poppet valve 6 is in operative connection with the activation lever 3, which is mounted movably on a support bearing 5 on the cylinder head. The activation lever 3 is deflected by a cam on the camshaft 2 counter to a spring force of a spring 7. For example, a rotary movement of the camshaft 2 brings about a deflection movement of the activation lever 3. Deflection of the activation lever 3 alters the angle between the activation lever 3 and the cylinder head. The deflection movement of the activation lever 3 is converted into a rectilinear movement of the second lever 4. The deflection of the activation lever 3 determines the extent of the movement of the second lever 4, where the second lever 4 actuates the poppet valve 6, and hence also the depth of the valve lift.

For example, if the adjusting shaft 1 actuates the activation lever 3 to a minimum angular position and the camshaft 2 does not deflect the movement of the activation lever 3, then a valve position may be a minimum lift position. Alternatively, if the adjusting shaft 1 actuates the activation lever 3 to a minimum angular position and the camshaft 2 does deflect the movement of the activation lever 3, then the valve position may be a zero-lift (e.g., closed) position.

The range in which the activation lever 3 brings about a movement of the poppet valve 6 by way of the second lever 4 is varied by adjusting the angular position of the activation lever 3 relative to the cylinder head. The larger the angle between the activation lever 3 and the cylinder head, the larger the range in which the deflection of the activation lever 3 acts on the second lever 4, and hence the poppet valve 6 opens correspondingly further. Alternatively, the smaller the angle between the activation lever 3 and the cylinder head, the smaller the range in which the deflection of the activation lever 3 acts on the second lever 4, and as a result the poppet valve 6 opens correspondingly less.

A plurality of cams on the camshaft 2 differ in design from one another, i.e. they have different cam profiles. Cams on the adjusting shaft 1 are preferably designed in such a way that they have a radius which becomes continuously greater in a radial direction in a second direction of rotation, up to a largest radius. In other words, the cams on the adjusting shaft 1 apply a greater force to the activation lever as the adjusting shaft is rotated in the first direction. At locations where the radii are unequal (e.g., between maximum rotations in the first and second directions), the cams of the adjusting shaft 1 are not in alignment and each subsequent cam applies a corresponding percentage of force to the activation lever 3.

For example, at a certain degree of rotation in the first direction, a first cam may apply a greatest force, while a second cam applies a second greatest force, where the second greatest force is a percentage (e.g., 66%) of the greatest force, and third cam may apply a third greatest force, where the third greatest force is a percentage (e.g., 33%) of the first greatest force. It will be appreciated that other percentages have been realized. Furthermore, each cam of the adjusting shaft 1 is in alignment at the largest radius of the adjusting shaft 1.

Said another way, the cams of the adjusting shaft 1 may apply differing radial effects onto the activation lever 3 when the adjusting shaft 1 is in a position between a position maximally in the first direction and a position maximally in the second direction. For example, if the adjusting shaft 1 is turning to a first position in the second direction, a single cam of the activating lever 3 applies a minimal radial effect while the remaining cams apply radial effects greater than the minimal radial effect.

Additionally or alternatively, two or more cams on the adjusting shaft 1 may have the same cam profiles. In accordance with this, it is also possible for several groups of cams on the adjusting shaft 1 to have the same cam profiles and for these groups to differ from one another. Thus, cylinders coupled to cams comprising similar cam profiles are adjusted in a similar manner. For example, the cylinder valves are moved to substantially similar positions in response to a rotation of the adjusting shaft 1.

As shown in FIG. 1A, a first cam on the adjusting shaft 1 is acting by means of its largest radius on the activation lever 3. A cam of the camshaft 2 is parallel with the activation lever 3 (e.g., no deflection force is applied). As a result, the maximum angular position of the activation lever 3 relative to the cylinder head, (i.e. the angle between the activation lever 3 and the cylinder head on the side of the camshaft 2), is shown.

Figure 1B:
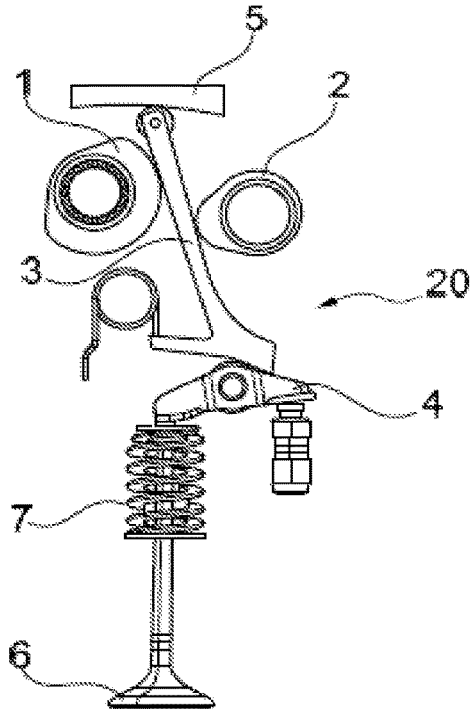
FIG. 1B shows the valve lift control device with a first cam on an adjusting shaft, where the adjusting shaft is acting on a first activation lever by means of its maximum radius.

Turning now to FIG. 1B, the VLCD 20 comprising the adjusting shaft 1 is shown in a substantially equal position as the adjusting shaft 1 of FIG. 1A. However, the camshaft 2 is depicted deflecting the activation lever 3 against a force being applied to the activation lever 3 by the adjusting shaft 1. The camshaft 2 may deflect the force of the adjusting shaft 1 onto the activation lever 3 by rotating such that the cam of the camshaft 2 is perpendicular to the activation lever 3. When the camshaft 2 deflects the activation lever 3 against the second lever 4, the poppet valve 6 is opened to the maximum extent. Full lift (e.g., valve opened to maximum extent) is the maximum depth of the poppet valve 6 which can be brought about by pressure from the second lever 4.

Figure 2A:
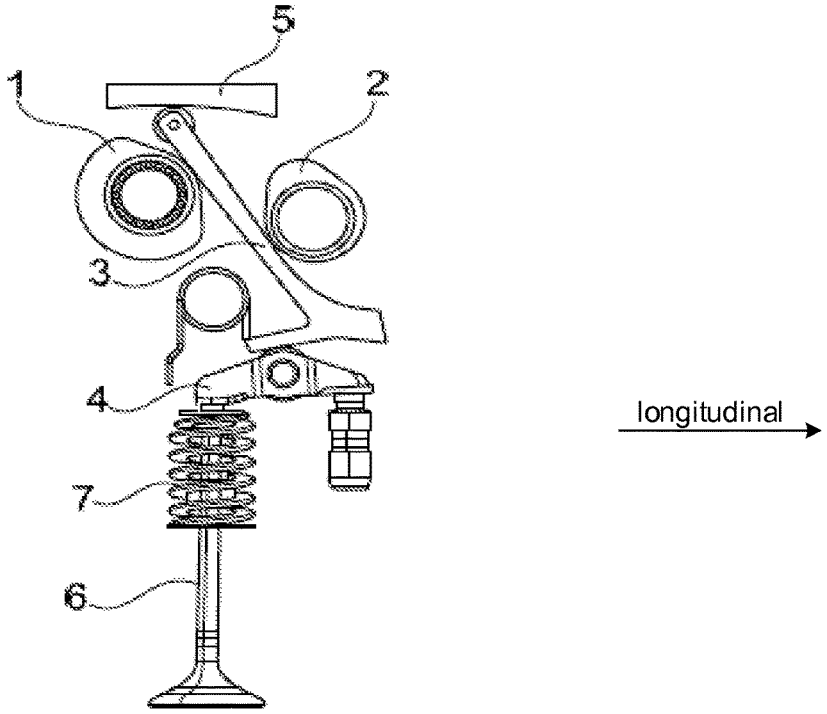
FIG. 2A shows the valve lift control device in a front view allowing a minimum valve lift.

Turning now to FIG. 2A, the VLCD 20 is shown in a minimum lift position. The minimum valve lift of the poppet valve 6, is brought about when a cam on the adjusting shaft 1 acts by means of its smallest radius on the activation lever 3 and the cam of the camshaft 2 is parallel to the activation lever 3 (e.g., the camshaft 2 does no deflect the activation lever 3).

Figure 2B:
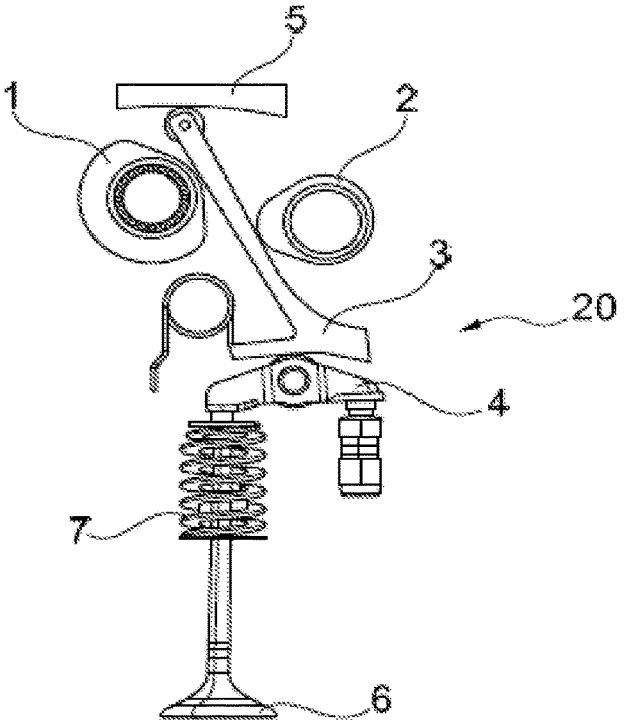
FIG. 2B shows the valve lift control device in a front view where the valve is closed.

Turning now to FIG. 2B, the VLCD 20 is shown in the zero-lift position and the poppet valve 6 being closed (e.g., zero-lift). When the camshaft 2 presses the activation lever 3 against the second lever 4 (e.g., the cam of the camshaft 2 is perpendicular to the activation lever 3), the poppet valve 6 is not opened. In the case of "zero lift", the poppet valve 6 is not opened since the deflection of the activation lever 3 does not bring about any movement of the second lever 4 which would open the poppet valve 6. Thus, zero lift is the minimum depth of the poppet valve 6 which can be brought about by pressure from the second lever 4. The corresponding cylinder is deactivated. As described above, the cams of the camshaft 2 may have different profiles. Thus, remaining cylinders may be active or deactivated.

Figure 3A:
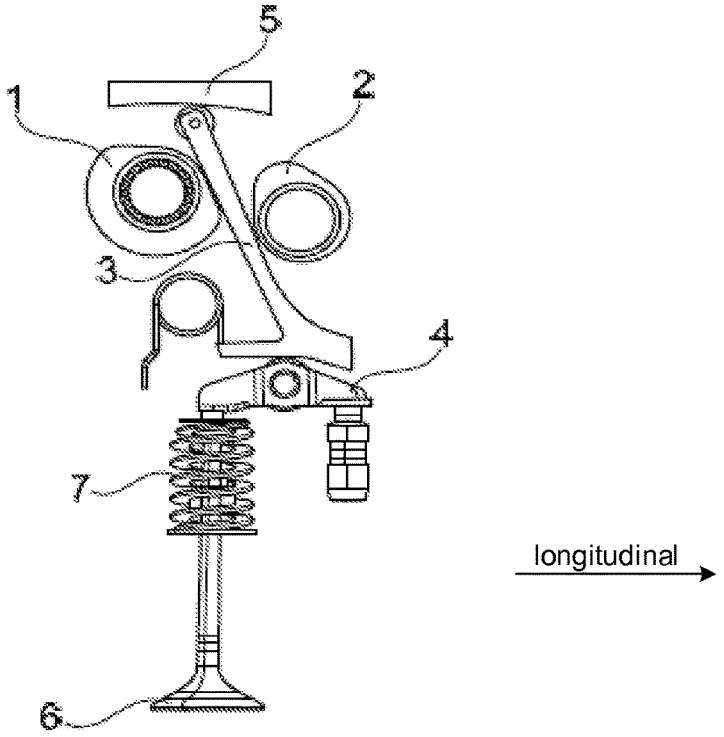
FIGS. 3A and 3B show the valve lift control device in a front view, wherein the first cam on the adjusting shaft is acting on the first activation lever by means of an intermediate radius.

Turning now to FIG. 3A, the VLCD 20 is shown with the poppet valve 6 in a partial lift position. The partial lift, between full lift and zero lift, occurs when the cam on the adjusting shaft 1 acts by means of a medium radius on the activation lever 3 while the cam of the camshaft 2 is parallel to the activation lever 3 (e.g., no deflecting force).

Figure 3B:
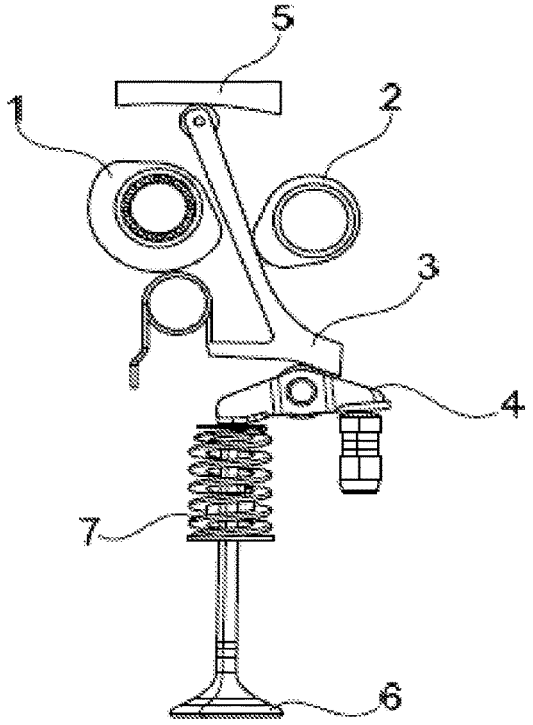

Turning to FIG. 3B, the VLCD 20 is shown with the poppet valve 6 in an open, partial lift position. The cam of the camshaft 2 is perpendicular to and presses the activation lever 3 against the second lever 4. Thus, the poppet valve 6 is opened, but not as far as in the case of a full lift, as shown in FIG. 1B.

The poppet valve 6 may be an intake valve or an exhaust valve. Thus, if the poppet valve 6 is at least partially open, then the poppet valve may at least allow intake air into a cylinder or allow exhaust gas to expel from the cylinder, respectively. In the poppet valve 6 is an intake valve and is closed, then the cylinder cannot receive intake air. If the poppet valve 6 is an exhaust valve and is closed, then the cylinder cannot expel exhaust gas. A partially opened poppet valve 6 admits less air or exhausts less combustion gas than a full opened poppet valve 6.

Turning now to FIG. 4, the adjusting shaft 1 is shown comprising four cams 11, 12, 13, and 14. The four cams 11, 12, 13, and 14 are arranged along the adjusting shaft 1 in such a way that they come into contact with the corresponding activation levers of individual cylinders. For example, cam 11 corresponds to a different cylinder than cams 12, 13, and 14 and as a result, cam 11 contacts a different activation lever than cams 12, 13, and 14.

As depicted, the cams 11, 12, 13, and 14 of the adjusting shaft are not aligned (e.g., each cam 11, 12, 13, and 14 may be applying a different degree of force to a corresponding activation lever). Furthermore, the cams 11, 12, 13, and 14 are depicted having different profiles. For example, cams 11, 12, and 13 are different shapes and sizes while cams 11 and 14 are substantially identical. If cams 11 and 14 are substantially identical, then their effects on the activation levers of their corresponding cylinders are also substantially identical. As described above, the cams 11, 12, 13, and 14 are aligned when each cam is at its maximum radius.

The cams 11 and 14 are radially aligned, wherein the cams 11 and 14 apply a similar radial effect (e.g., force) regardless of the rotation of the adjusting shaft 1. However, cams 11 (or 14), 12, and 13 apply different radial effects for a rotation of the adjusting shaft 1 between a maximal positions in the first direction and the second direction.

Turning now to FIGS. 5A and 5B, the adjusting shaft 1 is depicted turning in a first direction and a second direction, respectively. As depicted, the first direction and second direction are opposing directions. In one example, the first direction is counterclockwise and the second direction is clockwise. In another example, the first direction is clockwise and the second direction is counterclockwise.

By rotating the adjusting shaft 1 in the first direction, the cams 11, 12, 13, and 14 alter an angular position (e.g., increase the angular position) of an activation lever by means of their effective radii. For example, the effective radii of the cams are increased as the adjusting shaft 1 is further rotated in the first direction (e.g., a continuously increasing maximum permissible valve lift begins).

The adjusting shaft 1 can be rotated through a range of 270°, wherein the rotation of the adjusting shaft 1 is limited by a first fixing point in the region of the largest radii of all the cams 11, 12, 13, 14 and by a second fixing point in the region of the smallest radii of all the cams 11, 12, 13, 14 (e.g., the largest radii and the smallest radii positions are separated by 270°). In the case of a different design of the cams 11, 12, 13, 14, the adjusting shaft 1 can also be rotated through ranges of 180°, 210°, 240°, 300°, 330° or 360°. The largest radii of all the cams 11, 12, 13, and 14 is experienced in the first direction and the smallest radii of all the cams 11, 12, 13, and 14 is experienced in the second direction. In this way, the largest radii of the cams 11, 12, 13, and 14 maximally opens cylinder valves and the smallest radii minimally opens or closes cylinder valves.

Specifically, FIG. 5A depicts cams 11, 12, 13, and 14 aligned along a common axis. Thus, the cams 11, 12, 13, and 14 are at a maximum radius. Therefore, poppet valves of the cylinders may be at a full lift.

FIG. 5B depicts the adjusting shaft 1 turning in the second direction (e.g., clockwise) opposite the first direction (e.g., counterclockwise) of FIG. 5A. The cams 11, 12, 13, and 14 alter the angular position (e.g., decrease the angular position) of the activation lever by means of their effective radii. Thus, by rotating the adjusting shaft 1 in the second direction, the maximum valve lift is decreased based on a degree with which the adjusting shaft is rotated in the second direction (e.g., further rotation in the second direction further decreases the maximum valve lift experiences by one or more cylinder valves). Furthermore, each cylinder valve is adjusted to a different maximum valve lift due to the offset between cams 11, 12, and 13. In other words, the cams 11, 12, and 13 are radially misaligned at any point of rotation within the range of the adjusting camshaft 1 (e.g., for an adjusting camshaft between 0° to 270°, cams 11, 12, and 13 provide unequal radial effects on an activating lever). In this way, individual cylinders of a group of cylinders coupled to a single valve lift control device may be deactivated (e.g., shut-off) individually without using a hydraulic system.

As will be described below, the adjusting shaft 1 can be rotated to a first threshold to only shut-off a single cylinder of a cylinder group/bank, while the remaining active cylinders operate under decreased maximum valve lift conditions. The adjusting shaft can be rotated to a second threshold to deactivate a second cylinder of the cylinder group/bank. In this way, two cylinders are deactivated while other cylinders of the cylinder bank remain active.

For example, adjusting shaft 1 may be used to adjust a valve position of four cylinder with cams 11, 12, 13, and 14. As described above, cams 11 and 14 are substantially identical while comprising a different profile than cams 12 and 13. Cams 12 and 13 comprise different profiles than one another. In this way, if adjusting shaft 1 is rotated to the first threshold, then cam 12 may actuate a corresponding activation lever my means of its maximum radius, while cams 11, 13, and 14 actuate corresponding activation levers by a percentage of the maximum radius of cam 12, as described above. In this way, the cylinder corresponding to cam 12 is shut-off while cylinders corresponding to cams 11, 13, and 14 remain active.

Turning now to FIG. 6, the valve lift control device (VLCD) 20 is showing coupled to four cylinders of a cylinder row. As described above, the cams 11, 12, 13, and 14 are radially misarranged in order to allow each of the cams 11, 12, 13, and 14 to modify angular positions of the activation levers 31, 32, 33, and 34 of individual valves 61, 62, 63, and 64 of individual cylinders, respectively. Cam 11, activation lever 31 and valve 61 may correspond to a first cylinder. Cam 12, activation lever 32 and valve 62 may correspond to a second cylinder. Cam 13, activation lever 33 and valve 63 may correspond to a third cylinder. Cam 14, activation lever 34 and valve 64 may correspond to a fourth cylinder. In this way, the first, second, third, and fourth cylinders may be operated individual via a common VLCD 20. The VLCD comprising a single adjusting shaft 1 and a camshaft 2 on opposite sides of an activation lever (e.g., activation lever 31, 32, 33, and 34) able to modify a lift of a valve of an individual cylinder.

In the first cylinder, cam 11 acts on activation lever 31, which, through the action of the camshaft 2, acts on second lever 41, which, in turn, acts on poppet valve 61. In the second cylinder, cam 12 acts on activation lever 32, in the third cylinder cam 13 acts on activation lever 33 and, in the fourth cylinder, cam 14 acts on activation lever 34 with a corresponding action on second levers 42, 43 and 44 respectively, which, in turn, act on poppet valves 62, 63 and 64, respectively.

The activation levers 31, 32, 33, 34 of the individual cylinders can be successively brought into an angular position for a valve lift of the corresponding poppet valves 61, 62, 63, 64. By rotating the adjusting shaft 1 in a first direction (e.g., counterclockwise), an angular position of the activation levers 31, 32, 33, and 34 increases, which corresponds to a valve lift increasing (e.g., valve more open). By rotating the adjusting shaft 1 in a second direction (e.g., clockwise), the angular position of the activation levers 31, 32, 33, and 34 decreases, which corresponds to the valve lift decreasing (e.g., valve less open or zero lift (closed)). The cylinders with an angular position for zero lift are then deactivated. A method for operating the adjusting shaft 1 and the camshaft 2 for adjusting a valve position for a particular number of cylinders based on an engine operation is described below.

FIGS. 1-6 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example.

Turning now to FIG. 7, a schematic diagram showing one cylinder of a multi-cylinder engine 602 in an engine system 602, which may be included in a propulsion system of an automobile, is shown. The engine 602 may be controlled at least partially by a control system including a controller 604 and by input from a vehicle operator 606 via an input device 608. In this example, the input device 130 includes an accelerator pedal and a pedal position sensor 610 for generating a proportional pedal position signal. A combustion chamber 612 of the engine 602 may include a cylinder formed by cylinder walls 614 with a piston 616 positioned therein. The piston 616 may be coupled to a crankshaft 618 so that reciprocating motion of the piston is translated into rotational motion of the crankshaft. The crankshaft 618 may be coupled to at least one drive wheel of a vehicle via an intermediate transmission system. Further, a starter motor may be coupled to the crankshaft 618 via a flywheel to enable a starting operation of the engine 602.

The combustion chamber 612 may receive intake air from an intake manifold 622 via an intake passage 620 and may exhaust combustion gases via an exhaust passage 624. The intake manifold 622 and the exhaust passage 624 can selectively communicate with the combustion chamber 612 via respective intake valve 626 and exhaust valve 628. In some examples, the combustion chamber 612 may include two or more intake valves and/or two or more exhaust valves.

In this example, the intake valve 626 and exhaust valve 628 may be controlled by cam actuation via respective cam actuation systems 630 and 632. The cam actuation systems 630 and 632 may each include one or more cams and may utilize one or more of cam profile switching (CPS), variable cam timing (VCT), variable valve timing (VVT), and/or variable valve lift (VVL) systems that may be operated by the controller 604 to vary valve operation. The position of the intake valve 626 and exhaust valve 628 may be determined by position sensors 634 and 636, respectively. In alternative examples, the intake valve 626 and/or exhaust valve 628 may be controlled by electric valve actuation. For example, the cylinder 612 may alternatively include an intake valve controlled via electric valve actuation and an exhaust valve controlled via cam actuation including CPS and/or VCT systems.

A fuel injector 638 is shown coupled directly to combustion chamber 612 for injecting fuel directly therein in proportion to the pulse width of a signal received from the controller 604. In this manner, the fuel injector 638 provides what is known as direct injection of fuel into the combustion chamber 612. The fuel injector may be mounted in the side of the combustion chamber or in the top of the combustion chamber, for example. Fuel may be delivered to the fuel injector 638 by a fuel system (not shown) including a fuel tank, a fuel pump, and a fuel rail. In some examples, the combustion chamber 612 may alternatively or additionally include a fuel injector arranged in the intake manifold 622 in a configuration that provides what is known as port injection of fuel into the intake port upstream of the combustion chamber 612.

Spark is provided to combustion chamber 612 via spark plug 640. The ignition system may further comprise an ignition coil (not shown) for increasing voltage supplied to spark plug 640. In other examples, such as a diesel, spark plug 640 may be omitted.

The intake passage 620 may include a throttle 642 having a throttle plate 644. In this particular example, the position of throttle plate 644 may be varied by the controller 604 via a signal provided to an electric motor or actuator included with the throttle 642, a configuration that is commonly referred to as electronic throttle control (ETC). In this manner, the throttle 642 may be operated to vary the intake air provided to the combustion chamber 612 among other engine cylinders. The position of the throttle plate 644 may be provided to the controller 604 by a throttle position signal. The intake passage 620 may include a mass air flow sensor 646 and a manifold air pressure sensor 648 for sensing an amount of air entering engine 602.

An exhaust gas sensor 650 is shown coupled to the exhaust passage 624 upstream of an emission control device 652 according to a direction of exhaust flow. The sensor 650 may be any suitable sensor for providing an indication of exhaust gas air-fuel ratio such as a linear oxygen sensor or UEGO (universal or wide-range exhaust gas oxygen), a two-state oxygen sensor or EGO, a HEGO (heated EGO), a $NO_x$, HC, or CO sensor. In one example, upstream exhaust gas sensor 650 is a UEGO configured to provide output, such as a voltage signal, that is proportional to the amount of oxygen present in the exhaust. Controller 604 converts oxygen sensor output into exhaust gas air-fuel ratio via an oxygen sensor transfer function.

The emission control device 652 is shown arranged along the exhaust passage 624 downstream of the exhaust gas sensor 650. The device 652 may be a three way catalyst (TWC), $NO_x$ trap, various other emission control devices, or combinations thereof. In some examples, during operation of the engine 602, the emission control device 652 may be periodically reset by operating at least one cylinder of the engine within a particular air-fuel ratio.

An exhaust gas recirculation (EGR) system 654 may route a desired portion of exhaust gas from the exhaust passage 624 to the intake manifold 622 via an EGR passage 656. The amount of EGR provided to the intake manifold 622 may be varied by the controller 604 via an EGR valve 658. Under some conditions, the EGR system 654 may be used to regulate the temperature of the air-fuel mixture within the combustion chamber, thus providing a method of controlling the timing of ignition during some combustion modes.

The controller 604 is shown in FIG. 1 as a microcomputer, including a microprocessor unit 660, input/output ports 662, an electronic storage medium for executable programs and calibration values shown as read only memory chip 664 (e.g., non-transitory memory) in this particular example, random access memory 666, keep alive memory 668, and a data bus. The controller 604 may receive various signals from sensors coupled to the engine 602, in addition to those signals previously discussed, including measurement of inducted mass air flow (MAF) from the mass air flow sensor 646; engine coolant temperature (ECT) from a temperature sensor 670 coupled to a cooling sleeve 672; an engine position signal from a Hall effect sensor 674 (or other type) sensing a position of crankshaft 618; throttle position from a throttle position sensor 676; and manifold absolute pressure (MAP) signal from the sensor 648. An engine speed signal may be generated by the controller 604 from crankshaft position sensor 674. Manifold pressure signal also provides an indication of vacuum, or pressure, in the intake manifold 622. Note that various combinations of the above sensors may be used, such as a MAF sensor without a MAP sensor, or vice versa. During engine operation, engine torque may be inferred from the output of MAP sensor 648 and engine speed. Further, this sensor, along with the detected engine speed, may be a basis for estimating charge (including air) inducted into the cylinder. In one example, the crankshaft position sensor 674, which is also used as an engine speed sensor, may produce a predetermined number of equally spaced pulses every revolution of the crankshaft.

The storage medium read-only memory 664 can be programmed with computer readable data representing non-transitory instructions executable by the processor 660 for performing the methods described below as well as other variants that are anticipated but not specifically listed.

As described above, FIG. 1 shows only one cylinder of a multi-cylinder engine, and each cylinder may similarly include its own set of intake/exhaust valves, fuel injector, spark plug, etc.

The controller 604 receives signals from the various sensors of FIG. 7 and employs the various actuators of FIG. 7 to adjust engine operation based on the received signals and instructions stored on a memory of the controller.

Figure 8A:
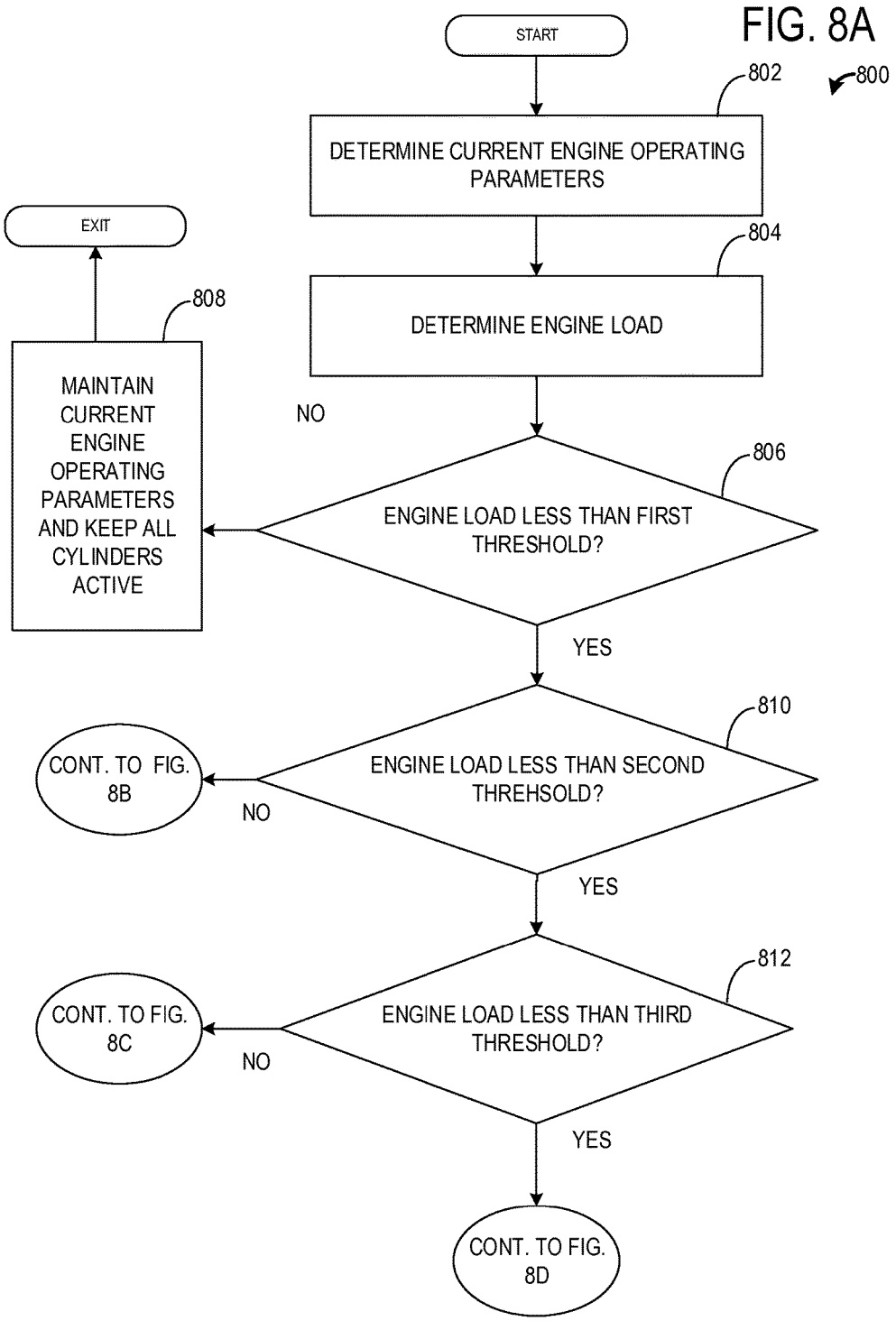
FIGS. 8A, 8B, 8C and 8D show a method for operating the camshaft.

As will be appreciated by someone skilled in the art, the specific routines described below in the flowcharts may represent one or more of any number of processing strategies such as event driven, interrupt-driven, multi-tasking, multi-threading, and the like. As such, various acts or functions illustrated may be performed in the sequence illustrated, in parallel, or in some cases omitted. Like, the order of processing is not necessarily required to achieve the features and advantages, but is provided for ease of illustration and description. Although not explicitly illustrated, one or more of the illustrated acts or functions may be repeatedly performed depending on the particular strategy being used. Further, these Figures graphically represent code to be programmed into the computer readable storage medium in controller 604 to be carried out by the controller in combination with the engine hardware, as illustrated in FIG. 1. Turning now to FIG. 8A, a method 800 for operating an adjusting camshaft in response to varying engine conditions is illustrated. Instructions for carrying out method 800 may be executed by a controller (e.g., controller 604) based on instructions stored on a memory of the controller and in conjunction with signals received from sensors of the engine system, such as the sensors described above with reference to FIG. 7. The controller may employ engine actuators of the engine system to adjust engine operation, according to the methods described below.

Method 800 may be carried out with reference to components described above. Specifically, method 800 may utilize components with reference to FIGS. 1-7 including but not limited to adjusting camshaft 1, camshaft 2, activating lever 3, second lever 4, spring 7, poppet valve 6, engine 602, and cylinder 612 via instructions from controller 604.

Method 800 describes an example valve lift control device similar to the valve lift control device depicted in FIG. 6. In such an example, the valve lift control device is able to adjust a valve lift position of a valve of an individual cylinder where the cylinder may belong to a cylinder bank comprising four cylinders. Furthermore, an adjustable camshaft depicted in FIG. 4 comprises cams 11, 12, 13, and 14, where cams 11, 12, and 13 are radially offset and cams 11 and 14 are radially aligned. In this way, cylinders corresponding to cams 11 and 14 (e.g., a first and fourth cylinder) have substantially identical valve lift positions during any rotation of an adjustable camshaft.

Method 800 begins at 802, where the method determines, estimates, and/or measures current engine operating parameters. The current engine operating parameters may include but are not limited to engine speed, manifold vacuum, vehicle speed, pedal position, throttle position, engine temperature, and air/fuel ratio.

At 804, the method 800 determines engine load. Engine load may be based on one or more of manifold vacuum, engine speed, and vehicle speed. It will be appreciated by someone skilled in the art that engine load may be determined from other suitable engine operating parameters (e.g., pedal position).

At 806, the method 800 includes determining if the engine load is less than a first threshold load. The first threshold load may be based on a high to mid load. If the engine load is greater than the first threshold load, then the method 800 proceeds to 808 and maintains current engine operating parameters and does not rotate an adjusting camshaft. By not rotating the adjusting camsahft, a valve position is maintained.

In one example, if the engine load is greater than the first threshold load, then the engine load may be a high load and the engine may desire maintaining all cylinders active in order to meet a torque demand and/or driver demand. Furthermore, the adjusting shaft may be fully rotated in a first direction in order to allow all the cylinder of an engine to have a maximum valve lift. In this way, no cylinders are deactivated when the engine load is greater than the first threshold load. Additionally or alternatively, one or more cylinder may be in a partial lift position based on the adjusting shaft being between a first position in the second direction and the maximum rotation in the first direction.

If the engine load is less than the first threshold load, then the method 800 proceeds to 810 to determine if the engine load is less than a second threshold load. The second threshold load is based on an engine load less than the first threshold load. As an example, the second threshold load may be based on a mid to low load.

Figure 8B:
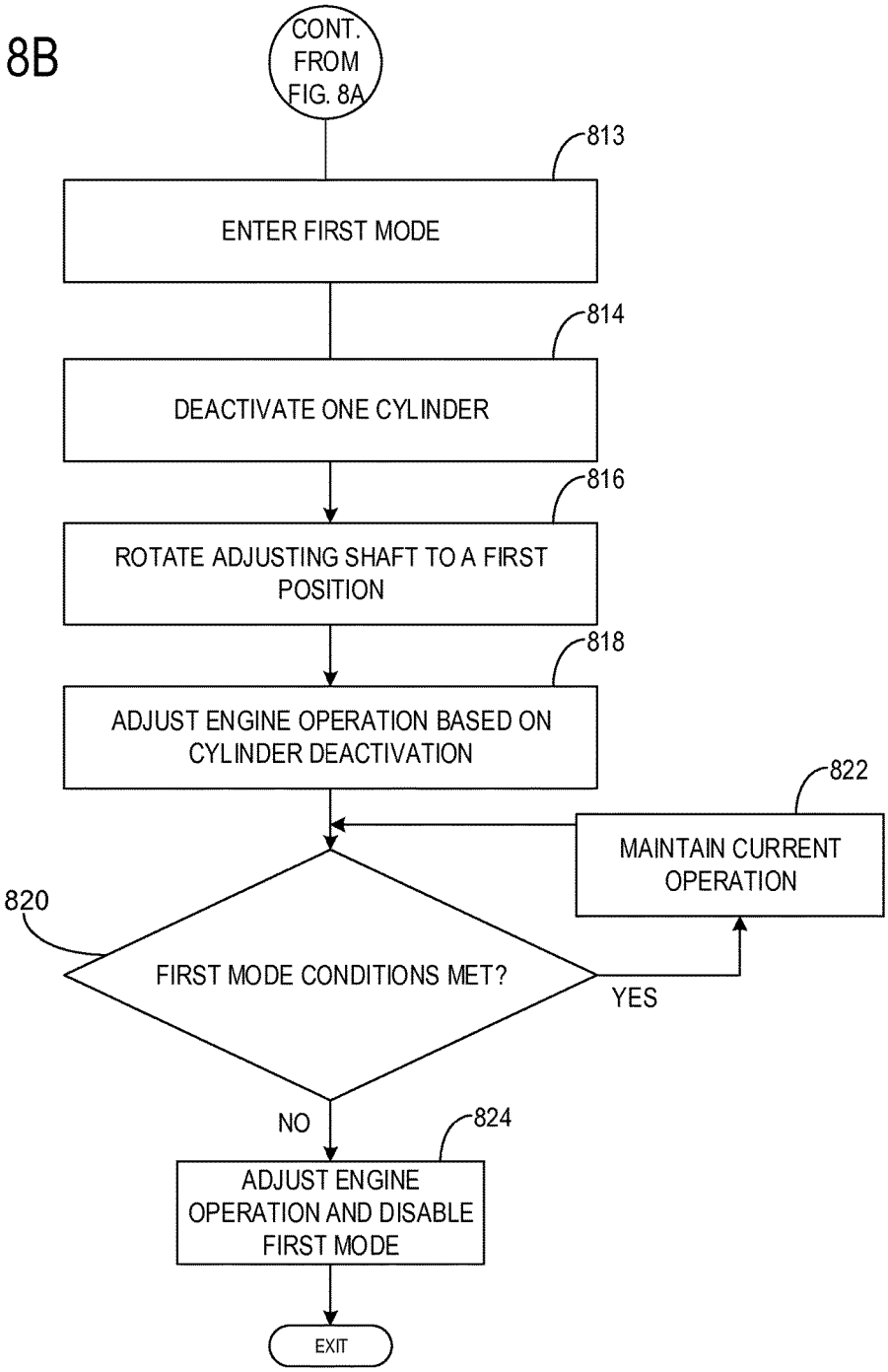

If the engine load is less than the first threshold load but not less than the second threshold load (e.g., engine load is between the first threshold and second threshold loads), then the method 800 proceeds to 813 of FIG. 8B. If the engine load is less than the second threshold load, then the method 800 proceeds to 812 to determine if the engine load is less than a third threshold load.

The third threshold load is less than both the first threshold load and the second threshold load. The third threshold load may be based on a low load. If the engine load greater than the third threshold and less than the second threshold, then the method 800 proceeds to 826 of FIG. 8C. If the engine load is less than the third threshold, then the method 800 proceeds to 840 of FIG. 8D.

Continuiing to FIG. 8B, the method 800 proceeds to 813 if the engine load is determined to be less than the first threshold and greater than the second threshold. At 813, the method 800 includes entering a first mode in order to deactivate a single cylinder of an engine at 814.

At 816, the method 800 includes rotating the adjusting shaft in a second direction to a first position. By rotating the adjusting shaft to a first position, a single cam of the adjusting camshaft actuates a corresponding activation lever of a corresponding cylinder to move a valve of the cylinder to a minimum lift position. The valve may then be closed via rotating a camshaft on an opposite side of the activation lever, in relation to the adjusting camshaft, such that a cam of the camshaft corresponding to the activation lever is perpendicular to the activation lever. In this way, the valve of the cylinder is closed (e.g., zero lift, as shown in FIG. 2B).

Furthermore, remaining cylinder of the cylinder bank or engine remain active due to the radial offset of the cams on the adjusting shaft. By turning the adjusting lever to the first position, only one cam of the adjusting camshaft applies a minimal radial effect onto the activation lever, thereby causing the valve of the cylinder to move to the minimum lift position. The remaining cams of the adjusting camshaft apply various radial effects such that valves of the remaining cylinders may be in partial lift or maximum lift positions.

At 818, the method 800 includes adjusting engine operation based on the cylinder deactivation. The adjusting may include adjusting fueling to the remaining active cylinders and adjusting a throttle position. In one example, a percentage of fuel that would have been injected into the deactivated cylinder may be equally partitioned and injected into the active cylinders. In another example, the percentage of fuel may be injected into only one of the remaining active cylinders. Furthermore, the throttle position may be moved to a more open position in order to compensate for the increased volume of fuel being delivered to the active cylinders.

At 820, the method 800 includes determining if first mode conditions are still met. As described above, the first mode conditions include the engine load being less than the first threshold load and greater than the second threshold load. If the first mode conditions are met, then the method 800 proceeds to 822 and maintains current operation and remains in the first mode by maintaining only one cylinder deactivated. The method 800 continues to monitor first mode conditions until first mode conditions are no longer met.

Returning to 820, if first mode conditions are not met, then the method 800 proceeds to 824 and adjusts engine operation and disables the first mode. The first mode conditions may be no longer met if the engine load is no longer less than the first threshold or if the engine load falls below the second threshold.

If the engine load increases beyond the first threshold, then the method 800 activates the deactivated cylinder by rotating the adjusting camshaft in a first direction in order to increase an angular position of the activating lever, thereby increasing a valve lift of a valve of the deactivated cylinder. Further adjustments may include adjusting spark and fueling to the cylinders in order to maintain a transient torque demand.

If the engine load decreases and becomes less than the second threshold load, then the method 800 may rotate the adjusting camshaft further in the second direction toward a second position, wherein a second cylinder may become deactivated, as will be described below with respect to FIG. 8C. In this way, the first and the second cylinders are deactivated in response to the decrease in engine load.

Figure 8C:
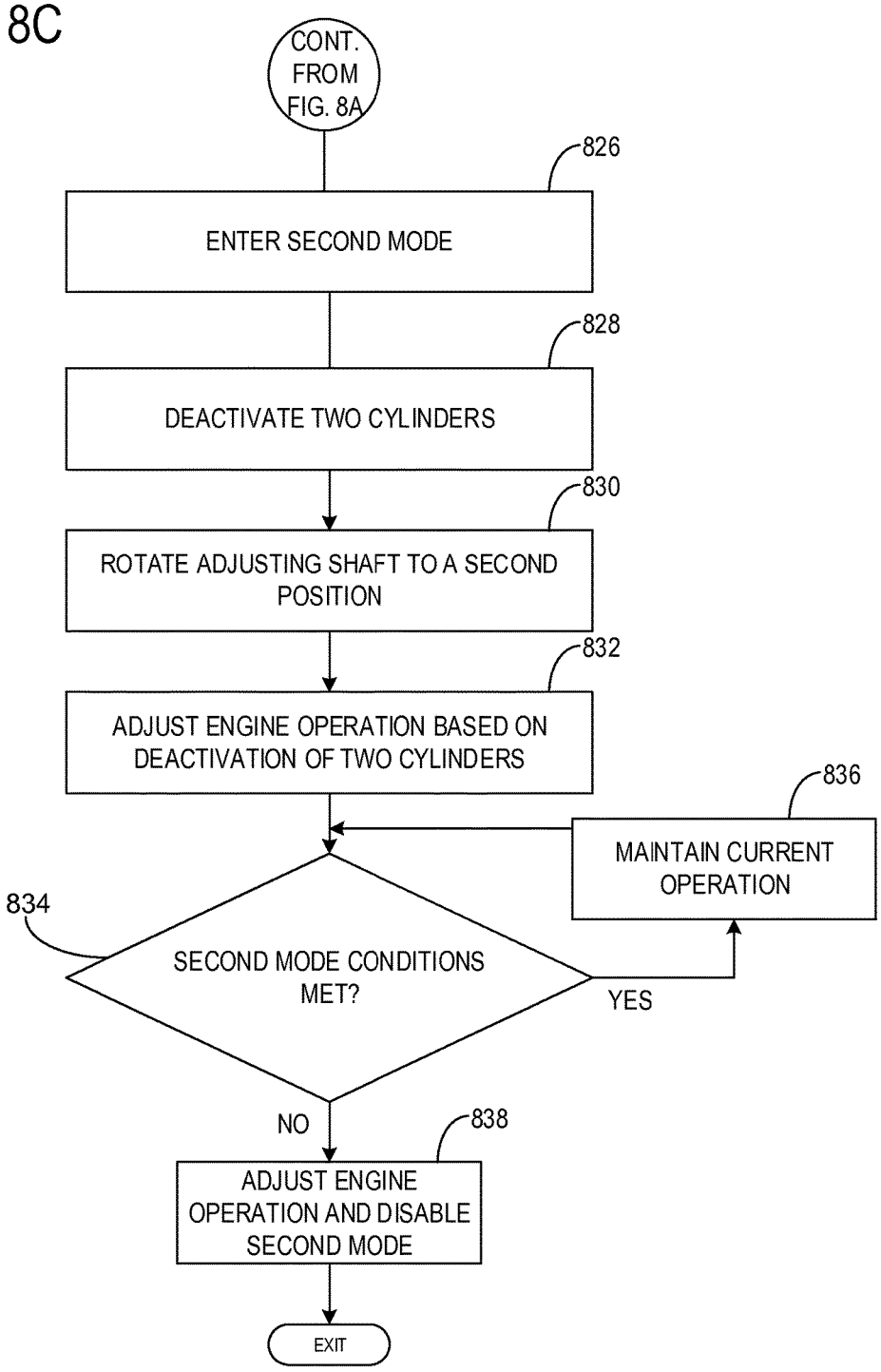

Returning to 810 of FIG. 8A, if the method 800 determines the engine load is less than the second threshold and greater than the third threshold, then the method 800 proceeds to 826 of FIG. 8C, as described above.

At 826, the method 800 enters a second mode, where the second mode includes deactivating two cylinders at 828.

At 830, the method 800 rotates the adjusting camshaft in the second direction toward a second position in order to deactivate a first cylinder and subsequent second cylinder, while allowing remaining cylinders to be active (e.g., firing). The second position is further in the second direction than the first position. Thus, the adjusting shaft passes the first position and therefore deactivates a first cylinder before rotating to the second position and deactivating a second cylinder. Furthermore, the camshaft, on an opposite side of the activating lever, rotates in order for cams of the camshaft to be perpendicular to the activating levers corresponding to the deactivated cylinders. This enables the valves of the deactivated cylinders to have zero-lift.

At 832, the method 800 includes adjusting engine operation based on deactivation of two cylinders. Adjustments may include altering an amount of fuel delivered to the active cylinders, wherein the adjusted fuel amount includes a nominal fuel amount and a percentage of a fuel amount that would have been delivered to the deactivated cylinders. In this way, the active cylinders receive a greater volume of fuel than the cylinders would receive if all cylinders were active. To compensate for the increased fuel injection volume, a throttle position is moved to a more open position in order to flow a greater amount of intake air to the active cylinders in order to maintain an air/fuel ratio.

At 834, the method 800 includes determining if second mode conditions are still met. As described above, the second mode conditions include the engine load being less than the second threshold load and greater than the third threshold load. If the second mode conditions are met, then the method 800 proceeds to 836 and maintains current engine operation and the two cylinders remain deactivated.

If the second mode conditions are not met, then the method 800 proceeds to 838 and adjust engine operation and disables the second mode. The second mode conditions may be non longer met if the engine load is no longer less than the second threshold or if the engine load falls below the third threshold.

If the engine load increases beyond the second threshold load, then the method 800 may activate one or more of the deactivated cylinders based on the engine load increase. For example, if the engine load increases beyond the second threshold load, but remains less than the first threshold load, then the method 800 may activate only one of the deactivated cylinders and shift to the first mode by rotating the adjusting shaft in the first direction toward the first position. As another example, if the engine load increases beyond the second threshold and first threshold loads, then the method 800 may activate all of the deactivated cylinders by rotating the adjusting shaft in the first direction.

If the engine load decreases and becomes less than the third threshold load, then the method 800 may enter the third mode by rotating the adjusting camshaft further in the second direction toward a third position, as will be described below with respect to FIG. 8D.

Figure 8D:
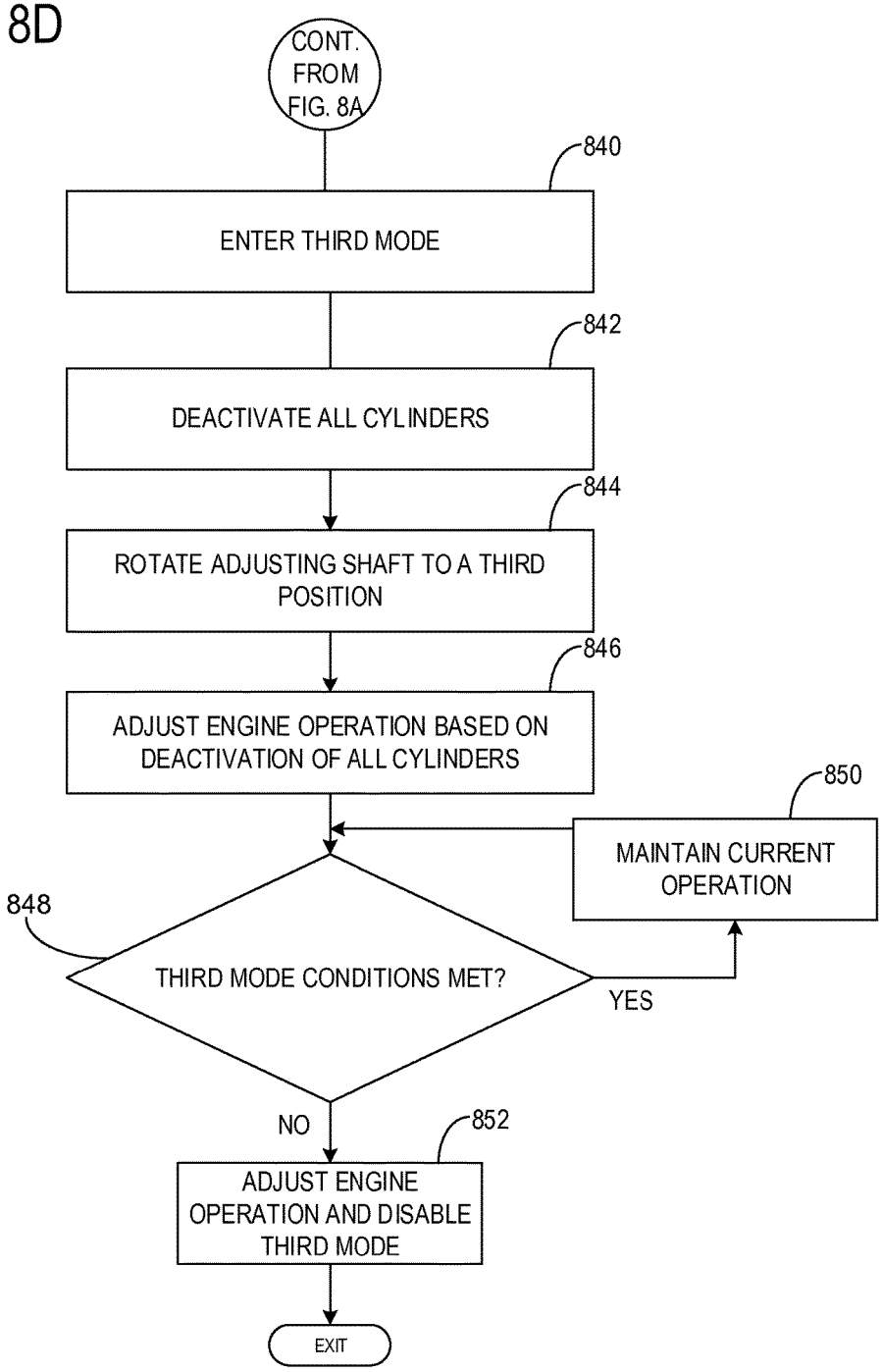

Returning to 812 of FIG. 8A, if the method 800 determines the engine load is less than the third threshold load and therefore less than the first and second threshold loads as well, then the method 800 proceeds to 840 of FIG. 8D, as described above.

At 840, the method 800 enters a third mode, where the third mode includes deactivating all cylinders at 842.

At 844, the method 800 rotates the adjusting camshaft in the second direction toward a third position in order to deactivate all the cylinders of an engine. The third position is further in the second direction than the second and first positions. Thus, the adjusting shaft passes the first position and the second positions before rotating to the third position. Therefore, the method 800 deactivates a first cylinder and a second cylinder before rotating to the third position and deactivating a third and fourth cylinders. Furthermore, the camshaft, on an opposite side of the activating lever, rotates in order for cams of the camshaft to be perpendicular to the activating levers corresponding to the deactivated cylinders (e.g., all the cams of the camshaft are perpendicular to the activating levers). This enables the valves of the deactivated cylinders to have zero-lift. Additionally, as described above, all the cams of the adjusting camshaft are radially aligned when in the third position (e.g., maximally rotated in the second direction). In this way, each cam has a minimal radial effect onto corresponding activating levers.

At 846, the method 800 includes adjusting engine operation based on deactivation of all the cylinders. Adjustments may include disabling fuel injection and spark to all the deactivated cylinders. Furthermore, the throttle may be moved to a fully closed position.

At 848, the method 800 includes determining if third mode conditions are still met. As described above, the third mode conditions include the engine load being less than the third threshold load. If the third mode conditions are met, then the method 800 proceeds to 850 and maintains current engine operation and the cylinders remain deactivated.

If the third mode conditions are not met, then the method 800 proceeds to 852 and adjusts engine operation and disables the third mode. The third mode conditions may be non longer met if the engine load is no longer less than the third threshold.

If the engine load increases beyond the third threshold, then the method 800 may activate one or more of the deactivated cylinders based on a magnitude of the engine load increase. For example, if the engine load increases beyond the third threshold load, but remains less than the second load, then the method 800 may activate two of the deactivated cylinders and shift to the second mode by rotating the adjusting shaft in the first direction toward the second position. As another example, if the engine load increases beyond the third and second threshold loads, then the method 800 may enter the first mode and operate with only a single deactivated cylinder while firing the remaining cylinders. As another example, if the engine load increases beyond the second and first threshold loads, then the method 800 may activate all of the deactivated cylinders by rotating the adjusting shaft in the first direction.

The method 800 illustrates a method for operating a valve lift control device for a cylinder bank of an engine, the valve lift control device is able to adjust a valve position of corresponding cylinders responsive to a change in engine load. The valve lift control device may disable one or more cylinders of the engine in response to a magnitude of the engine load decreasing.

In this way, a single valve lift control device may adjust valve positions of corresponding cylinders of an engine without being coupled to a hydraulic system. In this way, a packaging of the valve lift control device is decreased. Furthermore, by rotating an adjusting shaft of the valve lift control device in a first direction, the valve positions of the cylinders increases toward a maximum lift position. Conversely, rotating the adjusting shaft of the valve lift control device in a second direction changes valve positions of the valves of the cylinders to less than maximum lift positions. In one example, by rotating to a first position in the second direction, only a single cylinder may be deactivated. In another example, rotating to a second position in the second direction may deactivate one or more cylinders of the engine. Rotating to a third position in the second direction may deactivate all cylinders of the engine. As described above, the adjusting shaft has radially offset cams such that the cams apply a different radially effect onto an activation lever in order to sequentially deactivate cylinders of the engine. The technical effect of utilizing radially offset cams on the adjusting shaft is to adjust one or more valve positions of corresponding cylinders of an engine via a valve lift control device that does not use a hydraulic system.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

adjusting a valve lift of a valve coupled to a cylinder via an adjusting camshaft on a first side of an activation lever and a camshaft on a second side of the activation lever, the adjusting camshaft comprising radially offset cams such that the valve lift of the valve of the cylinder is individually adjusted based on an engine load, the activation lever including an end in face-sharing contact with a second lever coupled to a valve stem of the valve;

wherein rotating the adjusting camshaft in a first direction increases an angular position of the activation lever and rotating the adjusting camshaft in a second direction decreases the angular position of the activation lever;

wherein the second direction is opposite the first direction; and wherein rotating the adjusting camshaft in the second direction includes rotating the adjusting camshaft into a zero-lift position to deactivate the valve.

2. The method of claim 1, further comprising increasing the valve lift in response to increasing the angular position of the activation lever and decreasing the valve lift in response to decreasing the angular position of the activation lever.

3. The method of claim 1, wherein the adjusting camshaft comprises a maximum radial effect and a minimum radial effect.

4. The method of claim 3, wherein the maximum radial effect corresponds with a maximum angular position of the activation lever and fully rotating the adjusting camshaft in the first direction.

5. The method of claim 4, wherein the minimum radial effect corresponds with a minimum angular position of the activation lever and fully rotating the adjusting camshaft in the second direction.

6. The method of claim 5, wherein the first direction is clockwise and the second direction is counterclockwise.

7. The method of claim 5, wherein the first direction is counterclockwise and the second direction is clockwise.

* * * * *